US009117416B2

(12) United States Patent
Chen et al.

(10) Patent No.: US 9,117,416 B2
(45) Date of Patent: Aug. 25, 2015

(54) ACTIVE MATRIX DISPLAY DEVICE WITH PIXEL CHARGING TIME EXTENDING FUNCTION

(75) Inventors: Pei-Yi Chen, Hsin-Chu (TW); Chun-Wei Huang, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 1078 days.

(21) Appl. No.: 12/792,828

(22) Filed: Jun. 3, 2010

(65) Prior Publication Data

US 2011/0298770 A1 Dec. 8, 2011

(30) Foreign Application Priority Data

Dec. 17, 2009 (TW) ..... 098143399 A

(51) Int. Cl.
*G09G 3/36* (2006.01)

(52) U.S. Cl.
CPC ..... *G09G 3/3648* (2013.01); *G09G 2300/0426* (2013.01); *G09G 2310/021* (2013.01); *G09G 2310/067* (2013.01); *G09G 2320/0261* (2013.01)

(58) Field of Classification Search
USPC ..... 345/87, 94, 98–100, 103
See application file for complete search history.

(56) References Cited

U.S. PATENT DOCUMENTS

| | | | | |
|---|---|---|---|---|
| 5,436,747 | A * | 7/1995 | Suzuki | 349/42 |
| 5,867,141 | A * | 2/1999 | Asada et al. | 345/100 |
| 5,940,059 | A * | 8/1999 | Lee et al. | 345/91 |
| 6,552,706 | B1 * | 4/2003 | Ikeda et al. | 345/96 |
| 2003/0146893 | A1 | 8/2003 | Sawabe | |
| 2004/0160403 | A1 | 8/2004 | Tsai | |
| 2006/0176261 | A1 * | 8/2006 | Nitta et al. | 345/94 |
| 2006/0176264 | A1 | 8/2006 | Go | |

FOREIGN PATENT DOCUMENTS

| | | | |
|---|---|---|---|
| CN | 1573459 | A | 2/2005 |
| CN | 101226290 | A | 7/2008 |
| CN | 200910002627 | | 6/2009 |
| JP | 9211423 | A | 8/1997 |
| TW | 200832329 | | 8/2008 |
| TW | 200836148 | A | 9/2008 |

* cited by examiner

*Primary Examiner* — Ram Mistry
(74) *Attorney, Agent, or Firm* — WPAT, PC; Justin King

(57) ABSTRACT

An exemplary active matrix display device includes a plurality of gate signal lines, a plurality of data signal lines and a plurality of pixel rows. The gate signal lines are independently driven from one another. Each of the pixel rows is electrically coupled to one of the gate signal lines and a part of the data signals lines. The pixel rows include a first pixel row and a second pixel row. The first pixel row and the second pixel row are not neighboring with each other. The gate signal line electrically coupled with the first pixel row and the gate signal line electrically coupled with the second pixel row are synchronously enabled.

7 Claims, 7 Drawing Sheets

ACTIVE MATRIX DISPLAY DEVICE WITH PIXEL CHARGING TIME EXTENDING FUNCTION

CROSS-REFERENCE TO RELATED APPLICATIONS

This application is based upon and claims the benefit of priority from the prior Taiwan Patent Application No. 098143399, filed Dec. 17, 2009, the entire contents of which are incorporated herein by reference.

BACKGROUND

1. Technical Field

The present invention generally relates to display technology fields and, particularly to an active matrix display device.

2. Description of the Related Art

In the market of display device, a driving frame frequency of most of liquid crystal display (LCD) panels is 60 Hz or 120 Hz. When playing dynamic image frames, an image ghost may appear due to the driving frame rate is not high enough. To solve this problem, a single action can be divided into many frames to be continuously played. Thus, the driving frame rate of the display panel must be much faster.

Usually, a driving time period of a frame is 1/f (where f is the driving frame frequency of the display panel). For a current standard of full high definition (FHD) that is 1920*1080 pixels, a charging time of a single frame driven at 60 Hz is about 16 milliseconds (ms), and a charging time of a single frame driven at 120 Hz is about 8 ms. If a driving frame frequency of 240 Hz is employed, the charging time of a single frame will be shortened to be 4 ms, and correspondingly a charging time of a single pixel in such frame is about only 3.5 microseconds (vs).

To solve the problem of the charging time of pixel is excessively short, a proposed solution in the prior art is that each two neighboring/adjacent gate signal lines are electrically connected to each other, so that two pixel rows can be charged at the same time. Herein, due to two pixel rows are written with display data signals at the same time, the charging time of pixel in a single pixel row is doubled.

However, the prior art would have following disadvantages: due to each two neighboring gate signal lines are electrically connected to each other, in one aspect, during a circuit layout design, other circuit(s) must be avoided be arranged between the two neighboring gate signal lines, which results in the layout design becomes too complex, in another aspect, signals provided to each two neighboring gate signal lines electrically connected to each other may mutually influence and interfere with each other.

BRIEF SUMMARY

Accordingly, the present invention is directed to an active matrix display device, so as to address the above-mentioned issues associated with the prior art.

More specifically, in a first aspect of an embodiment of the present invention, an active matrix display device includes a plurality of gate signal lines, a plurality of data signal lines and a plurality of pixel rows. The gate signal lines are independently driven from one another. Each of the pixel rows is electrically coupled to one of the gate signal lines and a part of the data signals lines. The pixel rows include a first pixel row and a second pixel row. The first pixel row and the second pixel row are not neighboring/adjacent with each other. The gate signal line electrically coupled with the first pixel row and the gate signal line electrically coupled with the second pixel row are synchronously enabled.

In an embodiment of the present invention, the gate signal line electrically coupled with the first pixel row and the gate signal line electrically coupled with the second pixel row have at least one of the other/rest gate signal line(s) arranged between.

In an embodiment of the present invention, a total length of charging time for the first pixel row and the second pixel row synchronously receiving display data signals from the data signal lines is substantially equal to a length of charging time for any one of the first pixel row and the second pixel row.

In an embodiment of the present invention, the active matrix display device includes a color filter substrate, a thin film transistor (TFT) array substrate and a display layer arranged/interposed between the thin film transistor array substrate and the color filter substrate. The gate signal lines, the data signal lines and the pixel rows all are arranged on the thin film transistor array substrate.

In a second aspect of an embodiment of the present invention, an active matrix display device includes a first gate signal line, a second gate signal line, a plurality of data signal lines, a first pixel row and a second pixel row. The first gate signal line and the second gate signal line are independently driven from each other. The first pixel row and the second pixel row are respectively electrically coupled to the first gate signal line and the second gate signal line. The first pixel row is electrically coupled to a part of the data signal lines. The second pixel row is electrically coupled to another part of the data signal lines. Moreover, the first gate signal line and the second gate signal line are enabled in order (i.e., generally sequentially enabled), and an enabled time period of the first gate signal line and another enabled time period of the second gate signal line are partially overlapped with each other.

In an embodiment of the present invention, the first pixel row and the second pixel row are neighboring with each other.

In an embodiment of the present invention, a total length of charging time for the first pixel row and the second pixel row orderly/sequentially receiving display data signals from the data signal lines is substantially shorter than the sum of lengths of charging time for the first pixel row and the second pixel row.

In an embodiment of the present invention, the active matrix display device includes a color filter substrate, a thin film transistor array substrate and a display layer arranged between the thin film transistor array substrate and the color filter substrate. The first and second gate signal lines, the data signal lines, and the first and second pixel rows all are arranged on the thin film transistor array substrate.

In the above-mentioned embodiments of the present invention, the charging time of pixel at a given display panel driving frame frequency is lengthened by employing the solution of that the gate signal lines are independently driven from one another. Compared with the prior art, it is unnecessary to take in consideration that how to avoid arranging other circuit(s) between the connected gate signal lines associated with the prior art during the circuit layout design, and gate driving signals on the gate signal lines may not mutually influence and interfere with each other.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
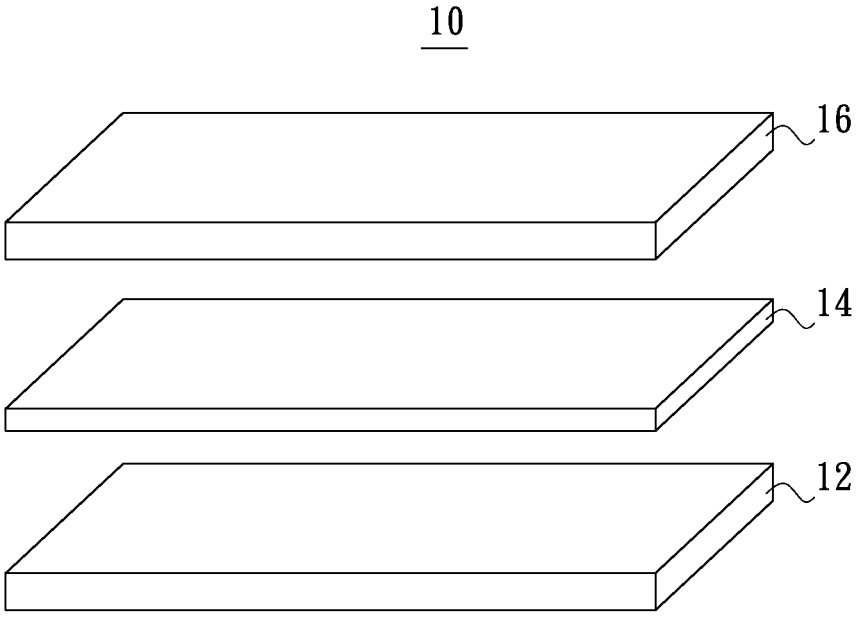
FIG. 1 is a schematic exploded perspective view of an active matrix display device according to an embodiment of the present invention.

Referring to FIG. 1, showing a schematic exploded perspective view of an active matrix display device according to an embodiment of the present invention. As shown in FIG. 1, the active matrix display device such as an active matrix LCD display device 10 includes a thin film transistor (TFT) array substrate 12, a color filter substrate 16 and a liquid crystal layer (i.e., a type of display layer) 14 between the TFT array substrate 12 and the color filter substrate 16. In the illustrated embodiment, the active matrix LCD display device 10 is taken for explanation but not to limit the present invention. The present invention also can be adapted for the other types of display devices such as a plasma display device, an organic electroluminescence display device, and so on.

Figure 2:
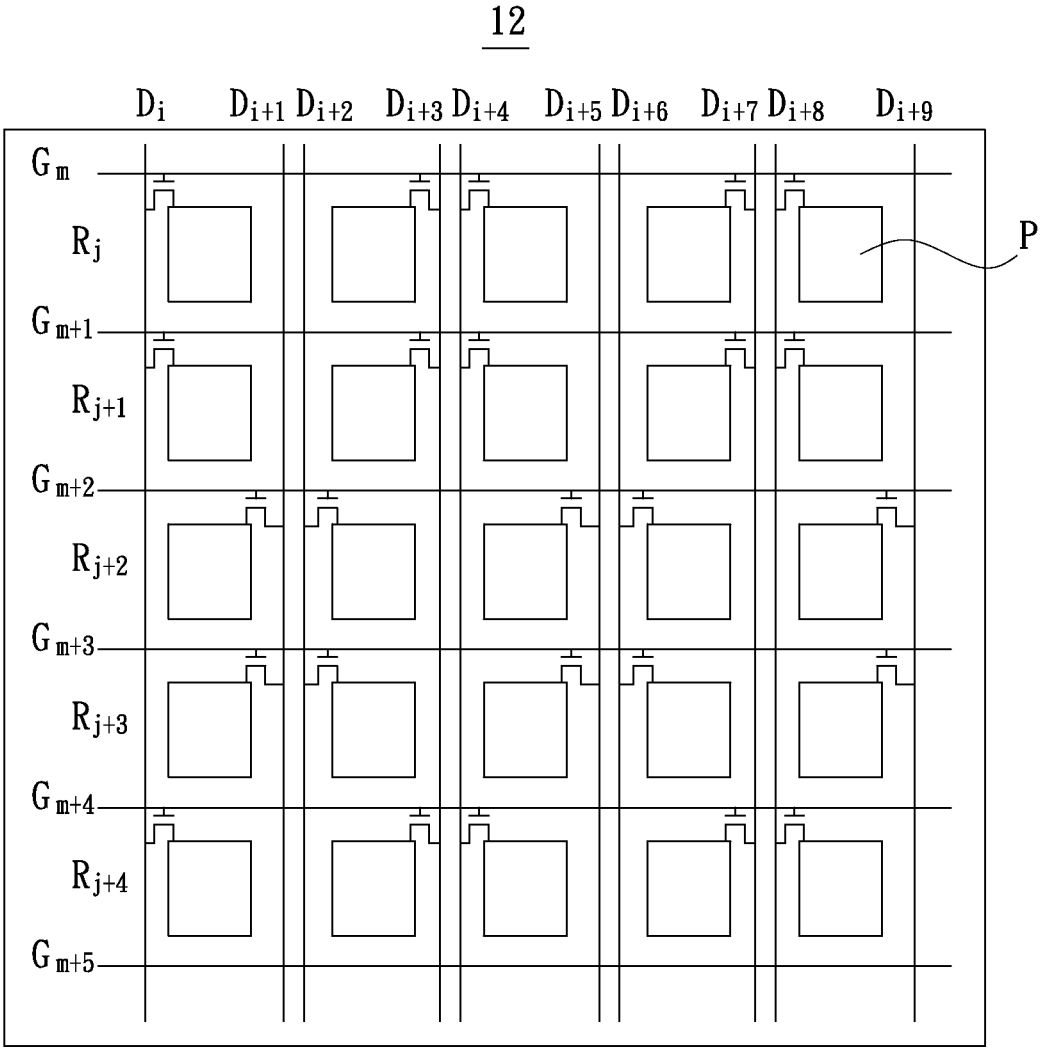
FIG. 2 is a schematic partial circuit diagram of a TFT array substrate of the active matrix display device as shown in FIG. 1.

Referring to FIG. 2, showing a schematic partial circuit diagram of the TFT array substrate 12 in FIG. 1. As shown in FIG. 2, the TFT array substrate 12 has gate signal lines $G_m$~$G_{m+5}$, date signal lines $D_i$~$D_{i+9}$ and pixel rows $R_j$~$R_{j+4}$ configured/disposed thereon. The gate signal lines $G_m$~$G_{m+5}$ are independently driven from one another. That is, the gate signal lines $G_m$~$G_{m+5}$ are configured without electrical connection among therewith, and the heads and tails thereof are disconnected from one another. The data signal lines $D_i$~$D_{i+9}$ are arranged crossing/intersecting with the gate signal lines $G_m$~$G_{m+5}$. The pixel rows $R_j$~$R_{j+4}$ are respectively electrically connected to the gate signal lines $G_m$~$G_{m+4}$. Each of the pixel rows $R_j$~$R_{j+4}$ includes a plurality of pixels P, for example, a red (R) pixel, a green (G) pixel, and a blue (B) pixel arranged in a certain regulation (arranged in a strip or delta manner). The pixels P of each of the pixel rows $R_j$~$R_{j+4}$ are electrically coupled to a part of the data signals lines $D_i$~$D_{i+9}$. For example, the pixels P in the pixel row $R_j$ are respectively electrically coupled to $D_i$, $D_{i+3}$, $D_{i+4}$, $D_{i+7}$ and $D_{i+8}$ of the data signal lines $D_i$~$D_{i+9}$. The pixel row $R_{j+2}$ is disposed spaced from the pixel row $R_j$ by the pixel row $R_{j+1}$ and the pixels P in the pixel row $R_{j+2}$ are respectively electrically coupled to $D_{i+1}$, $D_{i+2}$, $D_{i+5}$, $D_{i+6}$ and $D_{i+9}$ of the data signal lines $D_i$~$D_{i+9}$. In addition, the gate signal lines $G_m$~$G_{m+5}$ can be electrically coupled to a gate driving circuit (not shown) formed on the TFT array substrate 12 and for receiving gate driving signals. The data signal lines $D_i$, $D_{i+3}$, $D_{i+4}$, $D_{i+7}$ and $D_{i+8}$ and the data signal lines $D_{i+1}$, $D_{i+2}$, $D_{i+5}$, $D_{i+6}$ and $D_{i+9}$ can be respectively electrically coupled to two data driving circuits (not shown) arranged on the TFT array substrate 12 and for receiving display data signals.

Figure 3:
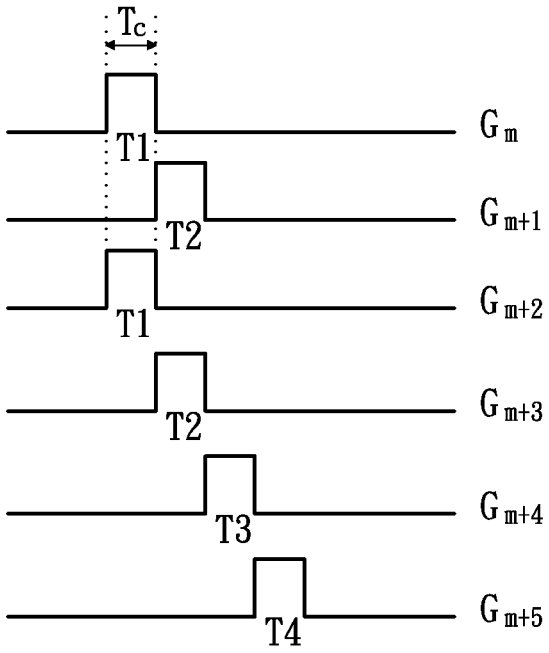
FIG. 3 is a timing diagram of gate driving signals of the gate signal lines on the TFT array substrate as shown in FIG. 2.

Referring to FIG. 3, showing a timing diagram of the gate driving signals of the gate signal lines $G_m$~$G_{m+5}$ in FIG. 2. Referring to FIGS. 2 and 3 together, the gate signal lines $G_m$ and $G_{m+2}$ are synchronously enabled during a time period T1. Correspondingly, the pixel rows $R_j$ and $R_{j+2}$ being not neighboring with each other and respectively electrically coupled to the gate signal lines $G_m$ and $G_{m+2}$ synchronously receive display data from the data signal lines $D_1$~$D_{i+9}$, a total length of charging time for the pixel rows $R_j$ and $R_{j+2}$ synchronously receiving the display data from the data signal lines $D_i$~$D_{i+9}$ is Tc. Herein, a length of charging time for the pixel rows $R_j$ receiving the display data from the data signal lines $D_i$, $D_{i+3}$, $D_{i+4}$, $D_{i+7}$, $D_{i+8}$ and another length of charging time for the pixel rows $R_{j+2}$ receiving the display data from the data signal lines $D_{i+1}$, $D_{i+2}$, $D_{i+5}$, $D_{i+6}$, $D_{i+9}$ both are equal to the time period T1, and in this situation, Tc is substantially equal to T1. Similarly, the gate signal lines $G_{m+1}$ and $G_{m+3}$ are synchronously enabled during a time period T2. Correspondingly, the pixel rows $R_{j+1}$ and $R_{j+3}$ being not neighboring with each other and respectively electrically coupled to the gate signal lines $G_{m+1}$ and $G_{m+3}$ synchronously receive display data from the data signal lines $D_1$~$D_{i+9}$, a total length of charging time for the pixel rows $R_{j+1}$ and $R_{j+3}$ synchronously receiving the display data from the data signal lines $D_i$~$D_{i+9}$ is equal to the time period T2. Thus, compared with a situation that only a single pixel row is charged during a time period, since the two pixel rows are synchronously charged at the same time, at the prerequisite of a given display panel driving frame frequency, the length of charging time of each pixel is doubled. In addition, due to the gate signal lines $G_m$~$G_{m+5}$ are independently driven from one another, during the circuit layout design, it is unnecessary to take in consideration that how to avoid arranging other circuit(s) between the connected gate signal lines associated with the prior art and the gate driving signals of gate signal lines $G_m$~$G_{m+5}$ may not mutually influence and interfere with each other. Furthermore, as seen from FIG. 3, the gate signal lines $G_{m+4}$ and $G_{m+5}$ are respectively enabled during time periods T3 and T4.

The above-mentioned embodiment of the present invention is not limited to charge the two pixel rows spaced from each other by another rest pixel row at the same time. Two pixel rows spaced from each other by a plurality of other pixel rows also can be charged at the same time, for example, FIGS. 4 and 5 showing an embodiment of two pixel rows spaced from each other by two other pixel rows are charged at the same time.

Figure 4:
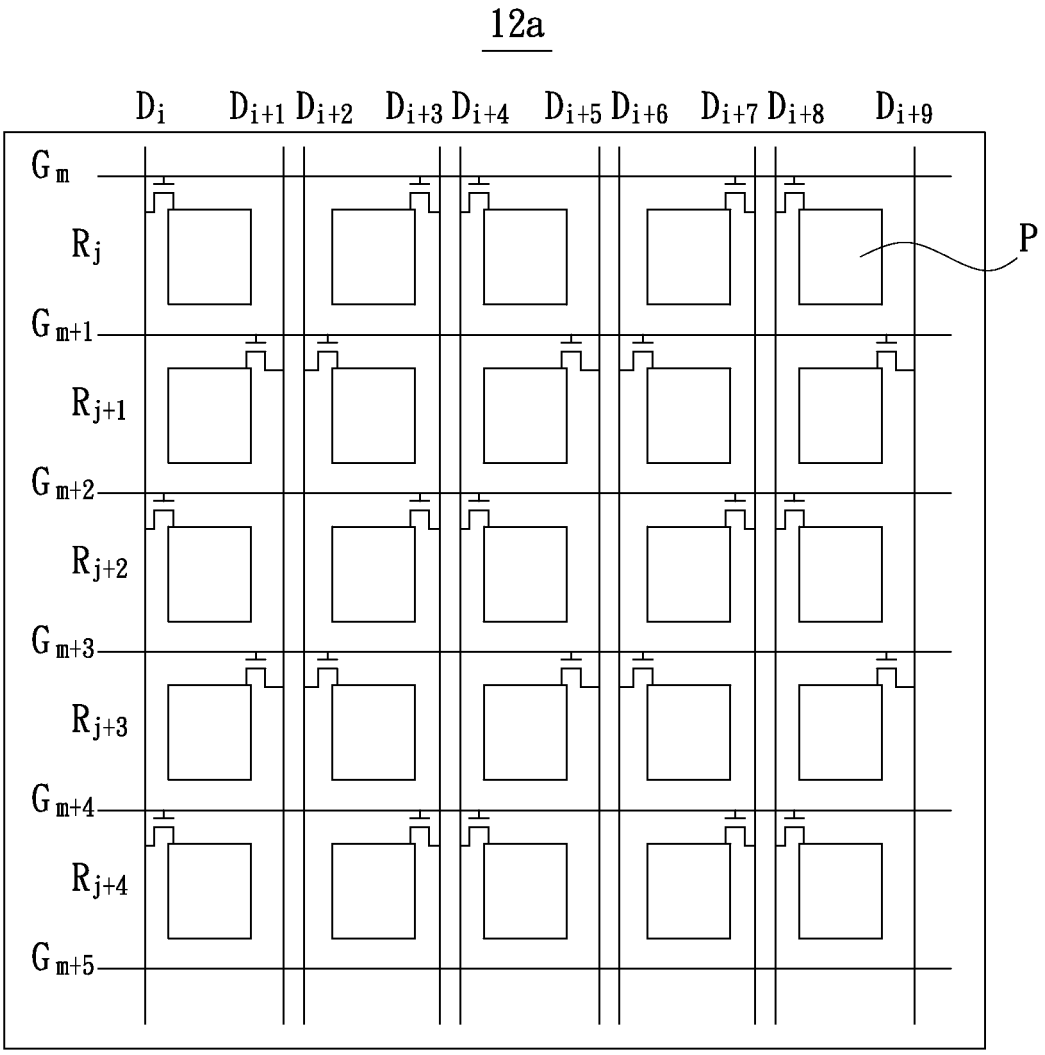
FIG. 4 is a schematic partial circuit diagram of a TFT array substrate according to another embodiment of the present invention.

More specifically, as shown in FIG. 4, gate signal lines $G_m$~$G_{m+5}$, date signal lines $D_i$~$D_{i+9}$ and pixel rows $R_j$~$R_{j+4}$ are configured on the TFT array substrate 12*a*. The gate signal lines $G_m$~$G_{m+5}$ are independently driven from one another. That is, the gate signal lines $G_m$~$G_{m+5}$ are configured without electrical connection among therewith, and heads and tails thereof are disconnected from one another. The data signal lines $D_i$~$D_{i+9}$ are arranged crossing with the gate signal lines $G_m$~$G_{m+5}$. The pixels $R_j$~$R_{j+4}$ are respectively electrically connected to the gate signal lines $G_m$~$G_{m+4}$. Each of the pixel rows $R_j$~$R_{j+4}$ includes a plurality of pixels P, for example, a red (R) pixel, a green (G) pixel, and a blue (B) pixel arranged in a certain regulation (e.g., arranged in a strip or delta manner). The pixels P of each of the pixel rows $R_j$~$R_{j+4}$ are electrically coupled to a part of the data signals lines $D_i$~$D_{i+9}$. For example, the pixels P in the pixel row $R_j$ are respectively electrically coupled to $D_i$, $D_{i+3}$, $D_{i+4}$, $D_{i+7}$ and $D_{i+8}$ of the data signal lines $D_i$~$D_{i+9}$. The pixel row $R_{j+3}$ is disposed spaced from the pixel row $R_j$ by the pixel rows $R_{j+1}$ and $R_{j+2}$, and the pixels P in the pixel row $R_{j+3}$ are respectively electrically coupled to $D_{i+1}$, $D_{i+2}$, $D_{i+5}$, $D_{i+6}$ and $D_{i+9}$ of the data signal lines $D_i$~$D_{i+9}$. Herein, the pixels P in the pixel row $R_{j+1}$ neighboring with the pixel row $R_j$ are also respectively electrically coupled to $D_{i+1}$, $D_{i+2}$, $D_{i+5}$, $D_{i+6}$ and $D_{i+9}$ of the data signal lines $D_i$~$D_{i+9}$.

Figure 5:
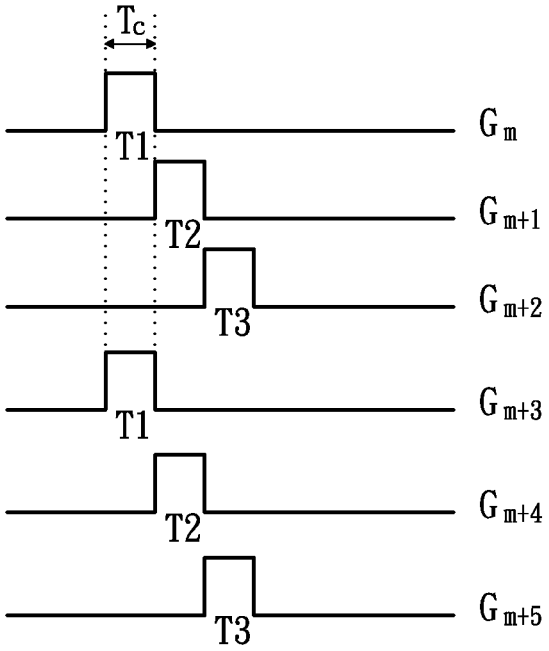
FIG. 5 is a timing diagram of gate driving signals of the gate signal lines on the TFT array substrate as shown in FIG. 4.

Referring to FIGS. 4 and 5 together, the gate signal lines $G_m$ and $G_{m+3}$ are synchronously enabled during a time period T1. Correspondingly, the pixel rows $R_j$ and $R_{j+3}$ being not neighboring with each other and respectively electrically coupled to the gate signal lines $G_m$ and $G_{m+3}$ synchronously receive display data from the data signal lines $D_i$~$D_{i+9}$, a total length of charging time for the pixel rows $R_j$ and $R_{j+3}$ receiving the display data from the data signal lines $D_i$~$D_{i+9}$ is Tc. Herein, a length of charging time for the pixel rows $R_j$ receiving the display data from the data signal lines $D_i$, $D_{i+3}$, $D_{i+4}$, $D_{i+7}$, $D_{i+8}$ and another length of charging time for the pixel rows $R_{j+3}$ receiving the display data from the data signal lines $D_{i+1}$, $D_{i+2}$, $D_{i+5}$, $D_{i+6}$, $D_{i+9}$ both are equal to the time period T1, and in this situation, Tc is substantially equal to T1. Similarly, the gate signal lines $G_{m+1}$ and $G_{m+4}$ are synchronously enabled during a time period T2. Correspondingly, the pixel rows $R_{j+1}$ and $R_{j+4}$ are being not neighboring with each other and respectively electrically coupled to the gate signal lines $G_{m+1}$ and $G_{m+4}$ synchronously receive display data from the data signal lines $D_i$~$D_{i+9}$, a total length of charging time for the pixel rows $R_{j+1}$ and $R_{j+4}$ receiving the display data from the data signal lines $D_i$~$D_{i+9}$ is equal to the time period T2. Furthermore, the gate signal lines $G_{m+2}$ and $G_{m+5}$ are synchronously enabled during a time period T3.

The present invention is not limited to the above-mentioned embodiments of charging two pixel rows at the same time to achieve the purpose of lengthening the charging time of pixel at a given driving frame frequency, another way/solution also can be adopted. For example, as shown in FIGS. 6 and 7, with a given display panel driving frame frequency, the length of charging time of pixel is lengthened by using the approach of sequentially/orderly enabling a plurality of gate signal lines and the enabled time periods of the gate signal lines being partially overlapped with one another.

Figure 6:
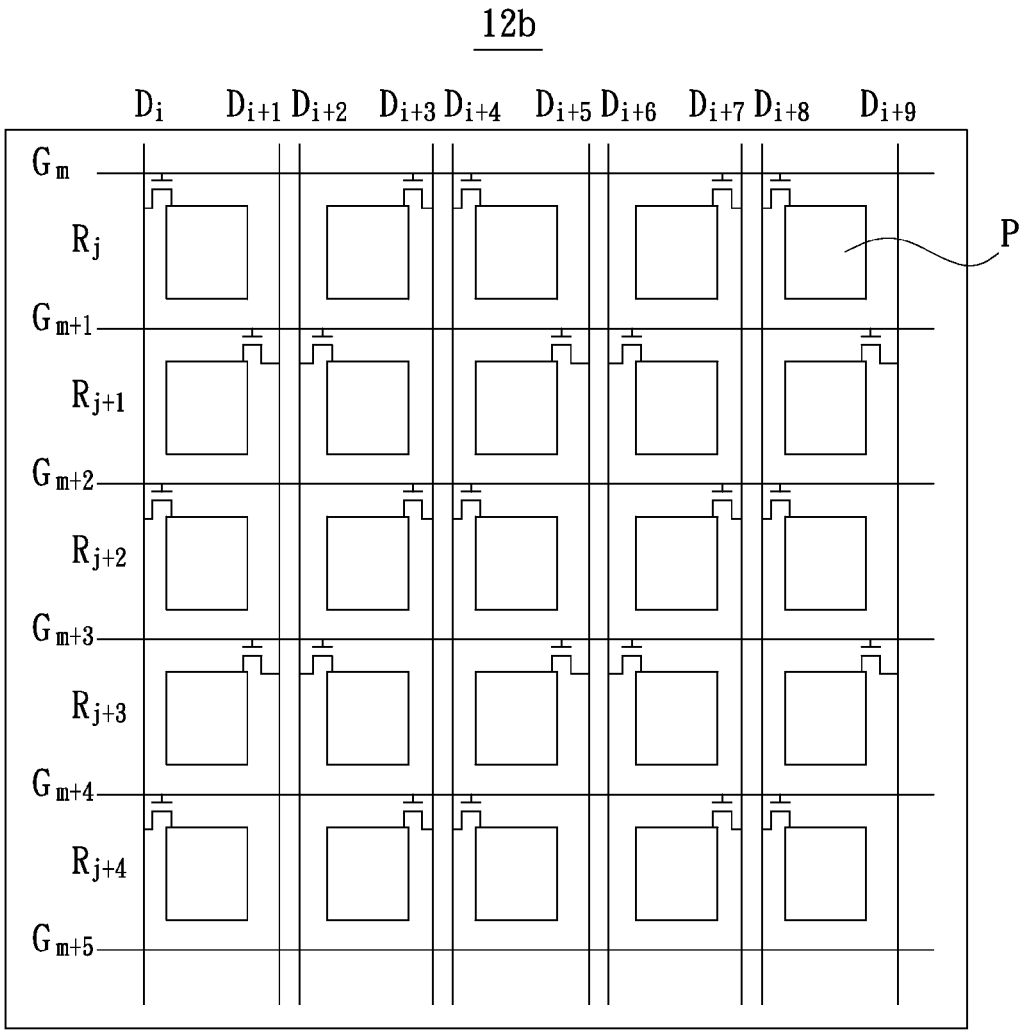
FIG. 6 is a schematic partial circuit diagram of a TFT array substrate according to still another embodiment of the present invention.

In particular, a TFT array substrate 12*b* shown in FIG. 6 is the same as the TFT array substrate 12*a* shown in FIG. 4, and thus will not be repeated herein.

Figure 7:
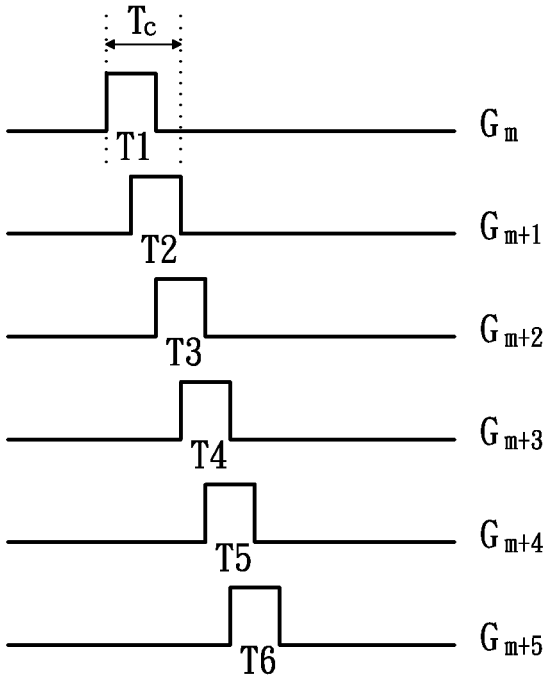
FIG. 7 is a timing diagram of gate driving signals of the gate signal lines on the TFT array substrate as shown in FIG. 6.

Referring to FIGS. 6 and 7 together, the gate signal lines $G_m$ and $G_{m+1}$ are enabled in order (i.e., generally sequentially enabled) in respective time periods T1 and T2. The enabled time periods T1 and T2 are partially overlapped with each other. Correspondingly, the pixel rows $R_j$ and $R_{j+1}$ being neighboring with each other and respectively electrically coupled to the gate signal lines $G_m$ and $G_{m+1}$ sequentially/orderly receive display data from the data signal lines $D_i$~$D_{i+9}$, a total length of charging time for the pixel rows Rj and $R_{j+3}$ orderly receiving the display data from the data signal lines $D_i$~$D_{i+9}$ is Tc. Herein, the length of charging time for the pixel rows $R_j$ receiving the display data from the data signal lines $D_i$, $D_{i+3}$, $D_{i+4}$, $D_{i+7}$, $D_{i+8}$ is equal to the enabled time period T1, and the length of charging time for the pixel rows $R_{j+1}$ receiving the display data from the data signal lines $D_{i+1}$, $D_{i+2}$, $D_{i+5}$, $D_{i+6}$, $D_{i+9}$ is equal to the enabled time period T2. Tc is less than the sum of the lengths of charging time T1 and T2. Similarly, the gate signal lines $G_{m+1}$ and $G_{m+2}$ are enabled in order in respective time periods T2 and T3, and the enabled time periods T2 and T3 are partially overlapped with each other. The gate signal lines $G_{m+2}$ and $G_{m+3}$ are enabled in order in respective time periods T3 and T4, and the enabled time periods T3 and T4 are partially overlapped with each other. The gate signal lines $G_{m+3}$ and $G_{m+4}$ are enabled in order in respective time periods T4 and T5 and the time periods T4 and T5 are partially overlapped with each other. The gate signal lines $G_{m+4}$ and $G_{m+5}$ are enabled in order in respective time periods T5 and T6 and the time periods T5 and T6 are partially overlapped with each other.

Accordingly, compared with a situation that only a single pixel row is charged during a time period, since each two neighboring pixel rows are charged in order and the charging time periods of the two neighboring pixel rows are partially overlapped with each other, at the prerequisite of a given display panel driving frame frequency, the charging time of each pixel can be extended/lengthened in some degree. In addition, due to the gate signal lines $G_m$~$G_{m+5}$ are independently driven from one another, during the circuit layout design, it is unnecessary to take in consideration that how to avoid arranging other circuit(s) between connected gate signal lines associated with the prior art, and the gate driving signals of gate signal lines $G_m$~$G_{m+5}$ may not mutually influence and interfere with each other.

As stated above, in the above-mentioned embodiments of the present invention, the pixel charging time can be extended at a given display panel driving frame frequency by using the solution of the gate signal lines being independently driven from one another. Compared with the prior art, it is unnecessary to take in consideration how to avoid arranging other circuit(s) between connected gate signal lines associated with the prior art during the circuit layout design, and the gate driving signals of gate signal lines may not mutually influence and interfere with each other.

Further, one skilled in the art could devise variations of the active matrix display device within the scope and spirit of the invention disclosed herein, for example, varying the electrical connection relationship between each pixel in each pixel row on the TFT array substrate and one of the data signal lines, and/or varying the type of the active matrix display device, such as the liquid crystal layer is replaced with an organic light-emitting diode (OLED) display layer, and so on.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An active matrix display device, comprising:

a plurality of gate signal lines being independently driven from one another;

a plurality of data signal lines; and a plurality of pixel rows, each of the pixel rows being electrically coupled to one of the gate signal lines and a part of the data signals lines, the pixel rows comprising a first pixel row, a second pixel row, a third pixel row and a fourth pixel row;

wherein the first pixel row and the second pixel row are not neighboring with each other, the gate signal line electrically coupled with the first pixel row and the gate signal line electrically coupled with the second pixel row are synchronously enabled;

wherein the third pixel row and the fourth pixel row are not neighboring with each other, the third pixel row and the first pixel row are neighboring with each other, the fourth pixel row and the second pixel row are neighboring with each other, the gate signal line electrically coupled with the third pixel row and the gate signal line electrically coupled with the first pixel row are not synchronously enabled, the gate signal line electrically coupled with the forth pixel row and the gate signal line electrically coupled with the second pixel row are not synchronously enabled, and the gate signal line electrically coupled with the third pixel row and the gate signal line electrically coupled with the fourth pixel row are synchronously enabled;

wherein pixels of the first pixel row and the second pixel row in a same column are electrically coupled with two adjacent data signal lines respectively, and the two adjacent data signal lines are only directly coupled with the pixels in the same column;

wherein different pixel rows are electrically coupled to different gate signal lines and each of the gate signal lines is only directly coupled to a corresponding one of the plurality of pixel rows, respectively.

2. The active matrix display device as claimed in claim 1, wherein the gate signal line electrically coupled with the first pixel row and the gate signal line electrically coupled with the second pixel row has at least one of the rest of the gate signal lines arranged therebetween.

3. The active matrix display device as claimed in claim 1, wherein a total length of charging time for the first pixel row and the second pixel row synchronously receiving display data signals from the data signal lines is substantially equal to a length of charging time for any one of the first pixel row and the second pixel row receiving the display data signals.

4. The active matrix display device as claimed in claim 1, wherein the active matrix display device comprises a color filter substrate, a thin film transistor array substrate and a display layer arranged between the thin film transistor array substrate and the color filter substrate; the gate signal lines, the data signal lines and the pixel rows are arranged on the thin film transistor array substrate.

5. The active matrix display device as claimed in claim 1, wherein the third pixel row is arranged between the first pixel row and the second pixel row.

6. The active matrix display device as claimed in claim 5, wherein pixels of the third pixel row and pixels of one of the first pixel row and the second pixel row in the same column are electrically coupled with the same data signal line.

7. The active matrix display device as claimed in claim 1, wherein each two adjacent pixel columns are disposed with two data signal lines therebetween.

* * * * *